United States Patent [19]

Stoll et al.

[11] Patent Number: 4,784,047

[45] Date of Patent: Nov. 15, 1988

[54] OSCILLATING PISTON MOTOR

[76] Inventors: Kurt Stoll, Lenzhalde 72, 7300 Esslingen; Georg Heid, Kernerstr. 5, 7120 Bietigheim-Bissingen; Albrecht Wagner, Bussardstr. 28, 7065 Winterbach; Gerhard Schrag, Im Braunkiel 14, 7305 Altbach, all of Fed. Rep. of Germany

[21] Appl. No.: 785,887

[22] Filed: Oct. 9, 1985

[30] Foreign Application Priority Data

Oct. 13, 1984 [DE] Fed. Rep. of Germany ..... 3437608

[51] Int. Cl.[4] ..... F01B 31/14; F15B 15/24; F01C 9/00

[52] U.S. Cl. ..... 92/13.5; 92/122; 92/125; 277/81 P; 277/207 R

[58] Field of Search ..... 92/120, 121, 125, 13.4, 92/13.41, 13.5, 122; 91/1, 329, 340; 277/81 P, 207 R; 418/112, 143

[56] References Cited

U.S. PATENT DOCUMENTS

| | | | |
|---|---|---|---|
| 2,209,921 | 7/1940 | Horton | 92/125 X |
| 3,688,645 | 9/1972 | Reaves | 92/125 |
| 4,155,685 | 5/1979 | Kunieda et al. | 418/112 |
| 4,611,530 | 9/1986 | Stoll et al. | 92/125 X |

FOREIGN PATENT DOCUMENTS

| | | | |
|---|---|---|---|
| 167155 | 11/1950 | Austria | 91/1 |
| 0136492 | 10/1985 | European Pat. Off. . | |
| 48103 | 3/1981 | Japan | 92/125 |
| 0007434 | of 1902 | United Kingdom | 91/339 |
| 0761729 | 11/1956 | United Kingdom . | |
| 1430196 | 3/1976 | United Kingdom . | |
| 2066901 | 7/1981 | United Kingdom . | |

*Primary Examiner*—Robert E. Garrett
*Assistant Examiner*—Mark A. Williamson
*Attorney, Agent, or Firm*—McGlew and Tuttle

[57] ABSTRACT

A hydraulic or pneumatic oscillating piston motor has a housing (1), a driven shaft (2) mounted in the housing for rotation and an oscillating piston (3) that is fixed to the shaft. The piston has two lever arms (49,8) having pressure areas of different size, which arms are sealed with respect to the housing (1) dividing the housing (1) into two working spaces (4,5) into which a pressure medium can be introduced. The oscillating piston (3), actuated by the pressure medium, is free to oscillate back and forth through a maximum angle of rotation which is determined by means of a stop (38) and the housing. The first lever arm is designated in the form of a bushing (49) whose shell surface along its external periphery is at least partly surrounded by a coaxial shell seal (64). This seal has uniformly distributed, rib-like sealing lips (75) along its periphery and interacts with a opposite surface (9) attached rigidly to the housing (1). The maximum angle of rotation of the oscillating piston (3) is at least 180° and can be set to smaller maximum angles.

14 Claims, 4 Drawing Sheets

OSCILLATING PISTON MOTOR

FIELD AND BACKGROUND OF THE INVENTION

The present invention concerns a hydraulic or pneumatic oscillating piston motor which has a housing, a driven shaft mounted in the housing with freedom to rotate and an oscillating piston that is rigidly attached to the shaft without freedom to rotate and that is designed as a lever with two arms having pressure areas of different size, which arms are sealed with respect to the housing. The piston divides the housing into two working spaces into which a pressure medium can be introduced and which are delimited by the two arms of the oscillating piston which maintain the seal when they move. The oscillating piston, actuated by a pressure medium, is free to oscillate back and forth through a maximum angle of rotation which is determined by means of a stop. The housing consists of a receptacle which surrounds the periphery of the shaft and which has no joints in the working space of the oscillating piston, and a cover that closes the receptacle.

An oscillating piston motor is described in German OS (laid open patent application) No. 23 09 959. In that case the maximum angle of rotation of the oscillating piston is approximately 90°. Larger angles of rotation are not possible, since, due to the design, the sealing effect decreases or is eliminated when the 90° mark is exceeded. The housing of the known oscillating piston motor has a wall with a contour consisting of essentially two circular sectors.

The front face of one of the arms of the lever can be moved along the circular arc surface of the first sector and is sealed off from this arc. The second, smaller arm of the lever is associated with the second sector and its sealed-off front face can likewise be displaced along the second circular arc. Both circular sectors have an aperture angle of approximately 90°, which establishes the maximum angle of rotation.

In order to limit the amplitude of the angle of rotation, a fixed stop is formed on one of the lever arms, which makes it impossible to arbitrarily preset a variable range for the angle of rotation.

SUMMARY OF THE INVENTION

It is a purpose of the present invention to create an oscillating piston motor of simple design which permits an oscillating motion of more than 90°, preferably at least 180°, and a continuously adjustable, reliable setting of an oscillating range betwen the two extreme strokes of the oscillating piston.

This purpose is achieved by designing the first lever arm in the dorm of a hollow cylindrical bushing which surrounds the driven shaft and whose shell surface along its external periphery is at least partly surrounded by a coaxial shell seal with uniformly distributed, rib-like sealing lips along the periphery. This shell seal interacts exclusively with an opposite surface attached rigidly to the housing, while the second lever arm has a larger radial span and is sealed off on all sides by means of a surrounding packing so that the maximum angle of rotation of the oscillating piston is at least 180° and that it can be preselected and set by means of an adjustable setting device. The tracks or contact paths in the housing on which the two lever arms of the oscillating piston run are arranged with respect to each other in such a manner that one of the lever arms can leave its track only after the other lever arm has reached the point of its maximum excursion.

The invention oscillating piston motor has the advantage that its oscillating range is considerably expanded, so that an oscillation of at least 180° or more can be achieved. Another advantage is its simple design, in particular, the sealing surface interacting with the shell seal need not have any particular shape. Instead, it may be designed as a flat surface on one of the housing parts, the cover or the receptacle, i.e. simply as a flat sealing surface, which can easily be produced with a standard tool, for example a grinding tool, which ensures costefficient manufacture of the oscillating piston motor. Since one of the lever arms has "degenerated" into a bushing surrounding the shaft, the first lever arm becomes very small and has no extended protrusions. The smaller this first lever arm is, the closer the drive shaft can be brought to a wall delimiting the housing, for example the cover, and the size of the opposing surface on the stationary part can simultaneously be decreased. The inventive oscillating piston motor has the further advantage that despite the great oscillating range of the oscillating piston, the only sealing combination required is between the housing material and the sealing material. A seal for this single combination can be very well designed to minimize wear, without the need for compromises.

According to one advantageous feature of the invention the sealing surface for the first small lever arm is defined on a cover for the housing which will ideally have an approximately square perimeter, need only be ground flat, for example, at one easily accessible place, in order to obtain the sealing area. The flat shape of the cover makes it easier to clamp while it is being machined.

By using a shell seal which covers at least 180° of the bushing, an angle of rotation of the oscillating piston of at least 180° can be obtained without a decrease in the sealing effect between the housing and the bushing forming the first lever arm. An arrangement of the invention wherein the second arm is symmetrical with the shell seal permits a symmetrical design of the oscillating piston motor and a correspondingly easy manufacturing process.

With the shell seal in the form of a hollow cylinder a reliable seat of the shell seal on the bushing is insured and simultaneously permits good sealing in every position of the oscillating piston.

The axial ends of the bushing are sealed with respect to the housing so as to divide the inside of the oscillating piston motor housing simply and reliably into two working spaces with a good seal.

All packings used to seal the piston with respect to the housing are made as one piece so that the seals for the oscillating piston can be manufactured easily and at low cost and also so that the packings can be mounted rapidly on the oscillating piston. In addition the one-piece design gives no opportunities for leaks, and the fact that the individual sealing is jointless ensures that is is securely seated at each corresponding sealing point.

The shell seal also has sealing lips extending therefrom. This optimizes the seal between the first lever arm, designed as the bushing, and the sealing surface interacting with it, for example on the housing cover. In particular, if the lips are formed on or attached to the periphery of the shell seal an intensified sealing action is obtained at the contact points between the sealing lips and the stationary sealing surface, so that a reliable seal is ensured even for high operating pressures.

The seal surface for the bushing can be formed directly on the cover. This makes it possible to dispense with a special seal for interacting with the sleeve lining, as the housing cover material itself is used directly as a sealing surface. This substantially reduces the number of parts subject to wear and simultaneously lowers the cost of producing the oscillating piston motor that is the subject of the present invention.

In order to take maximum advantage of the large range of angles of rotation for the inventive oscillating piston motor it is advisable to provide an adjusting device which acts between the rotating parts of the oscillating piston motor and the stationary housing section for changing the maximum angle of motion. It is advantageous for the adjusting device to include an adjusting disc which is firmly attached to the shaft and duplicates the oscillating motion of the oscillating piston. In this connection other refinements of the invention offer the advantage that the range of the oscillating piston's rotation can be continuously adjusted by moving stops which are fixable at different locations on the disk. The adjustment is made outside the oscillating piston housing and can take place at any position of the oscillating piston. Using other refinements of the invention, it is also possible to limit the angle of rotation of the shaft within the oscillating range defined by the two extreme positions of the piston. This is particularly advantageous if the driven shaft must be in a position which is predetermined from the outside.

According to another feature of the invention, a friction lining is applied to the surface of the disk at least in the area of the stops for helping to secure the stops at their selected locations. This prevents an accidental change in the position of the stops in relation to the corresponding adjusting disk. In particular, even when the stops make hard, percussive contact with the corresponding opposing stops which are solidly attached to the housing, a secure emplacement is assured. In addition to the clamping force which fastens the stop to the adjusting disk, there is thus also a friction factor which holds the stops in place, regardless of the stress applied thereto.

Still further refinements of the invention concern the frictional coating and the adjusting disk with which it is used. In particular the coating may be granular like sand paper. This contitutes a low-cost form of frictional coating which, in addition, ensures a reliable "braking" action between the two interacting parts. An additional protection against shifting between the adjusting disk and the stop can be obtained by providing a friction coating on the disk for two stops. This holding power is roughly double that of a simple type of frictional coating.

Another feature of the invention is the use of an indicator which is observable from outside of the housing and which indicates the instantaneous position of the oscillating piston. This permits the instantaneous position of the oscillating piston to be visible at all times from the outside of the housing. In this manner the instantaneous operating condition can always be checked and monitored without interrupting the operation of the oscillating piston motor. The indicator is advantageously fixed to the disk. This has the advantage that the position of the stops can simultaneously be read by means of the indicator.

The indicator of the invention may be in the form of a cap or hood which covers and is fixed to the adjusting disk for rotation therewith. A scale is provided on the cap. A pointer is fixed to the housing and can be used to read the indicator position from the scale on the cap. This is a low-cost and particularly well-designed variant of the indicator according to the invention, which completes the overall external appearance of the oscillating piston motor. At the same time, the scale does not interfere with any assembly or repair work, as it is automatically removed by taking off the cap or hood.

The cap has plural openings which make it possible to shift and adjust the stops at any time without having to remove the cap.

The distance between the driven shaft and the sealing surface against which the first lever arm engages is selected to correspond to a radial thickness of the bushing and shell seal. In this way the driven shaft can be brought very close to the inside of the housing cover, so that only a small sealing surface on the cover is required. The piston can be completely surrounded by packing for a single design of the stationary sealing surface, to obtain a large oscillating range for the oscillating piston, which covers at least 180°, as it is not necessary to provide sealing surfaces in any particular shape, for instance in the shape of an arc.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
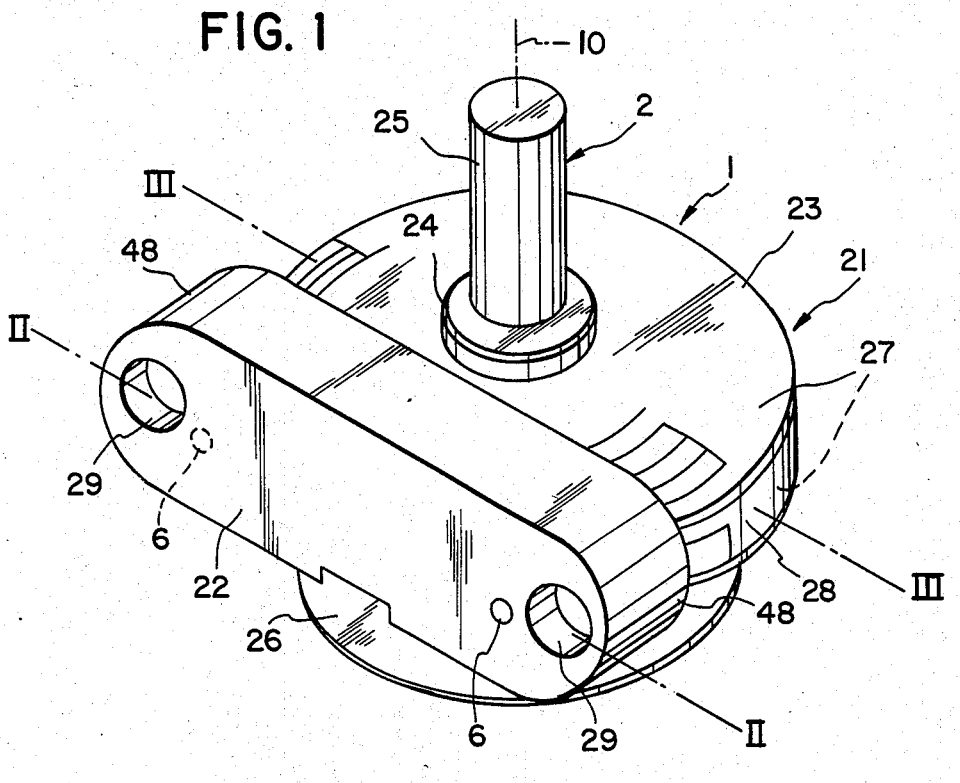
FIG. 1 is a perspective view of the housing of an embodiment of the oscillating piston motor according to the invention with the adjustment device at the bottom of the figure.
Figure 2:
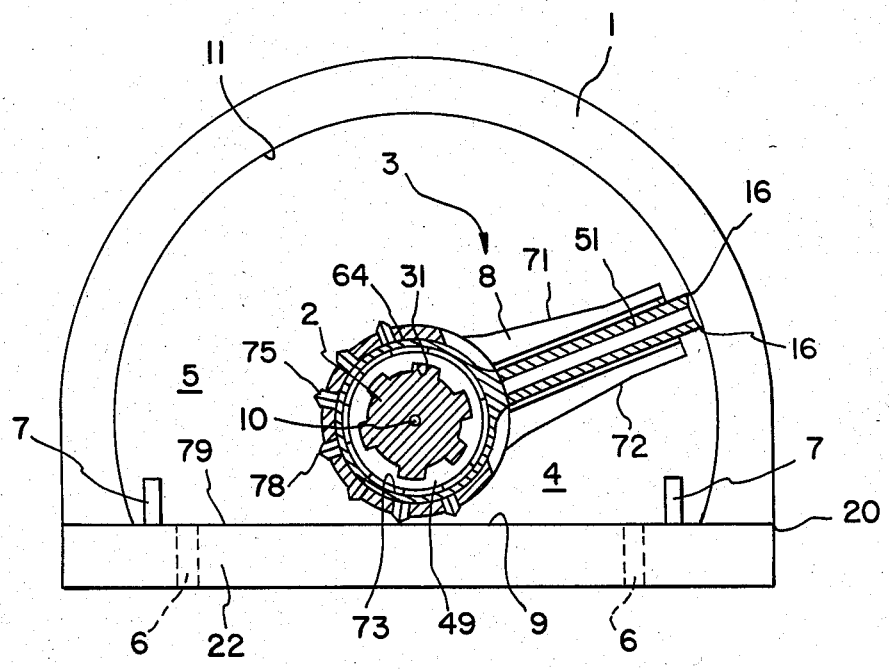
FIG. 2 is a schematic view of a section of the oscillating piston motor according to the invention taken along line II—II of FIG. 1.

Referring to the drawings, FIG. 2 shows a top sectional view of the basic design of the oscillating piston motor that is the subject of the present invention. It comprises a housing 1 and a shaft 2 mounted in the housing 1 with freedom to rotate. A clockwise and counterclockwise rotation is imparted to the shaft 2 by a pneumatic or hydraulic pressure medium. The angle of rotation of the shaft 2 can be predetermined within certain limits between two extreme positions. The driving action is produced through an oscillating piston 3 that is rigidly attached to the shaft 2 without freedom to rotate. Oscillating piston 3 divides the space in housing 1 into two working spaces 4,5, with a connection 6 for the pressure medium opening into each of the working spaces 4,5. If, by means of a control circuit that is not shown in detail, pressure is introduced into the working space 4 on one side of the oscillating piston 3 and the pressure is simultaneously released from the working space 5, then a rotation motion of the oscillating piston 3 about the axis of rotation defined by the shaft 2 takes place. Since the oscillating piston 3 and the shaft 2 are connected rigidly with one another without freedom to rotate, the rotary motion is transmitted to the shaft 2 and the latter is moved together with the oscillating piston 3. For the reversal of the oscillation, the supply of the pressure medium is switched, so that the introduction and release of the pressure medium into and from the working spaces 4,5 are reversed. Shaft 2 then rotates in the opposite direction. Shaft 2 projects outside the housing 1 (see FIG. 1) and makes it possible to connect any desired load, which will thus be rotated by the motor. The respective angle of rotation of the oscillating piston 3 and the shaft 2 is limited by the design. The embodiment of the oscillating piston motor shown in FIG. 2 permits a maximum angle of rotation of somewhat more than 180°. In order to limit the angle of rotation, end stops 7 are provided, which are formed on the housing 1 or rigidly connected to the housing 1. In FIG. 2, the end stops 7 are formed on the cover 22, which closes off the working spaces 4,5. The end stops are located in the path of the oscillating piston 3, so that is makes contact with them in its extreme positions. This determines the end positions of the oscillating piston 3, which in turn define the maximum angle of rotation. In addition to the end stops 7 there is, according to the invention, at least one other stop which FIG. 2 does not show in detail and which makes it possible to continuously adjust the angles of rotation and obtain any desired angle, even if it is smaller than the maximum of at least 180°.

Figure 3:
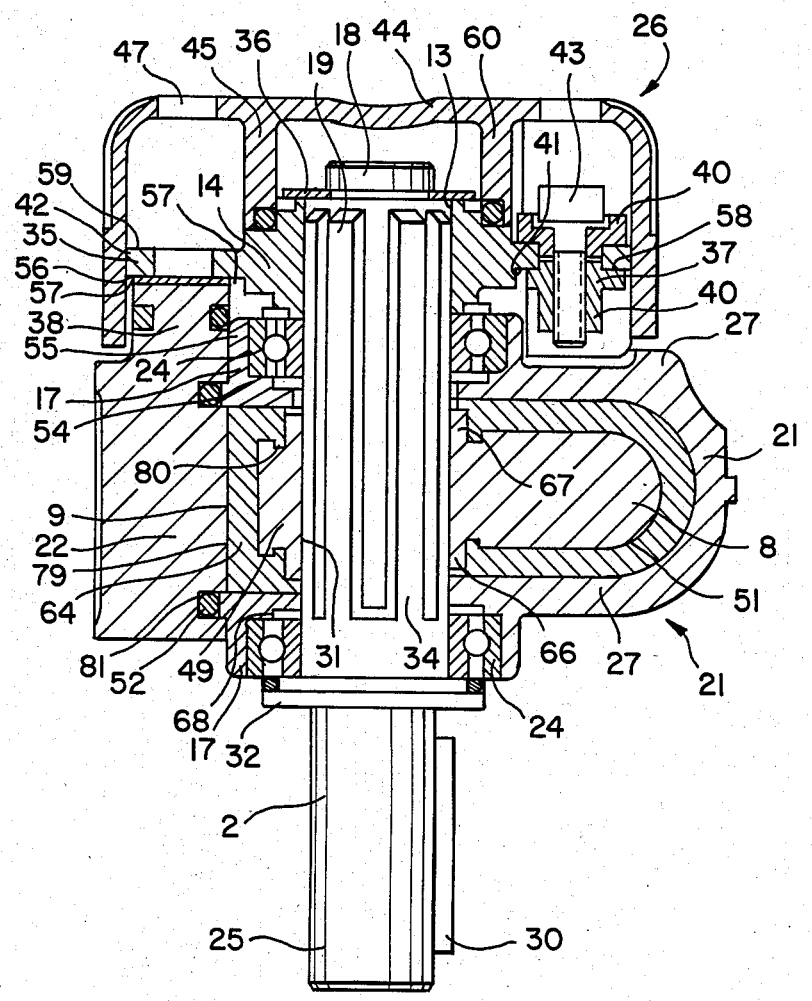
FIG. 3 is a longitudinal section through the oscillating piston motor according to the invention taken along line III—II of FIG. 1, with adjusting device attached and at the top of the figure.

As shown in FIGS. 2 and 3, the oscillating piston 3 comprises a bushing 49 which is mounted on the shaft 2 with splines (that is without freedom to rotate) and forms a first, small lever arm of the oscillating piston 3. Shaft 2 thus forms the bearing of the oscillating piston. In addition, the oscillating piston 3 has a second lever arm, which is referred to as the wing or vane 8 and whichis relatively long compared with the first lever arm. Wing 8 is located approximately at a right angle to the axis of rotation of longitudinal axis 10 of the shaft 2 and forms the essential part of the effective piston area of the oscillating piston motor. The purpose of this design is to keep the piston area of one of the lever arms very large and the piston area of the other lever arm very small, in order to eliminate almost entirely any mutually conflicting torques. Thus, the design of the oscillating piston shown in FIG. 2 may be considered for practical purposes as a single-arm lever. However, the thickness of the shaft 2 and the bushing 49, which, for reasons of stability and strength, is finite nevertheless always offers a surface, albeit only a small one, on which the pressures working against the driving force can act, so that the bushing 49 indeed works as a lever arm.

Bushing 49 fulfills the important function of completing the sealing-off of the two working spaces 4,5 from one another. Thus, when the oscillating piston 3 rotates, the vane or wing 8 moves with a sealing effect along the circular cylindrical shell surface 11, and the bushing 49 moves with a sealing effect along a flat opposite surface 9 of the housing 1. Shell surface 11 is coaxial with the axis of rotation 10 of the shaft 2. The distance of the circular cylindrical shell surface 11 from the axis of rotation 10 is substantially greater than its distance from the opposite surface 9. Shell surface 11 and the sealing surface 9 are arranged in relation to each other in such a way that the area defined by the shell surface and by the plane of the sealing surface 9 is in the shape of a cross-section of a circular cylinder, from which a part whose cross-section is in the shape of a segment of a circle or chord, has been removed. The size of the opposite surface 9 formed on the housing 1, preferably on the cover 22, is restricted to the area where the bushing 49 makes contact and may, for example, consist of a raised surface. The angle included by the shell surface 11 is essentially identical with the maximum angle of rotation of the oscillating piston 3, i.e. in FIG. 3 it is at least 180°.

The oscillating piston is sealed with respect to the housing by means of a one-piece packing 51, which will be explained in more detail below.

FIG. 1 shows a perspective view of the oscillating piston motor according to the invention, which represents an advantageous design of the exterior shape of the oscillating piston motor according to FIG. 2. It shows primarily the housing 1 which consists of the receptacle 21 and the cover 22, which closes off this receptacle and has approximately the shape of a rectangular prism. Receptacle 21 comprises an approximately semicircularcylindrical section 23, whose cylinder axis coincides with the axis of rotation or longitudinal axis 10 of the shaft 2. This shaft 2 passes through the receptacle 21 and extends on both sides beyond the receptacle 21. Shaft 2 is supported in bearings 24, for example ball or sleeve bearings, which are located at the points where the shaft penetrates the receptacle. A free end 25 of the shaft 2 extending beyond the receptacle serves to connect a load which is not shown. In addition to the semicircular-cylindrical section 23, the receptacle 21 also comprises two cover portions 27, facing each other, which adjoin the semicircular-cylindrical section 23 toward the cover 22 and are formed in one piece, with a smooth transitional section, on the semicircular-cylindrical section 23. Thus, the horizontal projection of the receptacle 21 is approximately that of a cut-off oval. The semicircular-cylindrical section 23 is essentially defined by a shell 28, on whose interior surface, which faces the interior of the housing, the shell surface 11 shown in FIG. 1 is formed. The flat back side of the receptacle 21, which faces away from the semicircular-cylindrical section 23 and the shell 28, is open, so that the oscillating piston 3 can be installed from this side. After the oscillating piston 3 has been installed, the opening is closed by means of the cover 22.

Cover 22, which has basically the shape of a rectangular prism, is rounded off or chamfered at its two free longitudinal edges 48 and provided with the assembly holes 28 for the insertion of fastening elements (not shown) for screwing the cover 22 onto the receptacle 21. For this purpose it is desirable to provide extensions or eyes (not shown), formed on or rigidly attached to the shell 28 of the receptacle 21, each of which has a thread into which the fastening elements can be screwed. The reference numbers 6 again refer to the openings for attaching lines carrying the pressure medium.

At the other free end of the shaft 2, (shown at 18 in FIG. 3) which is opposite the free end 25, is a stop or adjusting device 26 with which the angle of rotation of oscillating piston 3 can be set. Stop or adjusting device 26 will be explained in more detail below with the aid of additional figures.

Once again referring to FIG. 2 and also to FIG. 3, the packing 51 located on the oscillating piston 3, for sealing off the two working spaces 4,5 will be described. The one-piece packing 51 comprises a shell seal 64 which partly encloses the bushing 49 coaxially, a wing seal 65 which surrounds the wing 8 at its front surfaces 15, and a bushing seal section 68 located between the shell seal 64 and the wing seal 65 and sealing off the bushing 49 at its end faces 66,67 which seal section 68 extends a certain distance beyond the end faces 66,67 of the bushing 49. Wing seal 65 has the shape of a ribbon 69 which is tied into a front end groove 70 made in the end surfaces 15 of the wing 8. Sealing ribbon 69 extends slightly beyond the end surfaces 15 and is provided, as shown in FIG. 2, at each of the two sealing edges corresponding to the sides 71, 72 of the wing, with a continuation forming the sealing lip 16. The sealing lips 16 are thus parallel to the longitudinal direction of the sealing ribbon 69. The sides 71, 72 of the wing are made without any seal. It is only the shell surface 73 of the cylindrical bushing 49 that is surrounded by a seal, i.e. the shell seal 64. Shell seal 64 surrounds the bushing 49 on the side opposite to the wing 8 and covers an angle of at least 180° on the periphery of the bushing 49. The shell seal and the bushing 49 are approximately coaxial. In the area of each of the ends 74 of the shell seal which face the end surfaces 66,67 of the bushing 49 there is a bushing seal section 68 which connects the wing seal 65 and the shell seal 64. In order to fasten the bushing seal section 68 and the ends 74 of the shell seal 64 to the bushing 49, peripheral grooves (not shown) are provided in its end surfaces 66,67, which are approximately concentric to the axis of rotation 10 and into which the shell seal and the bushing seal sections can be connected. The entire packing unit described above is made in one piece and can be easily attached or connected to the oscillating piston. Along its periphery, the shell seal 64 has sealing lips 75 which are parallel to the axis of rotation 10, i.e. to the longitudinal axis of the bushing. These sealing lips 75 are made in one piece with the shell seal 64 and extend in an approximately radial direction, as seen from the axis of rotation 10, from the bushing 49. Shell seal 64 and the sealing lips 75 can be made together in such a way that the shell seal 64 acts as a base part for the sealing lips 75, which partly surrounds the bushing 49. However, another possibility would be to provide no sealing material between the individual sealing lips 75 on the periphery of the bushing 49 and to connect the sealing lips 75, by means of a ring-shaped bushing seal section 68, only at their ends 76,77 which face the end surfaces 66, 67 of the bushing 49. In order to ensure a secure seating for the sealing lips, a number of longitudinal grooves corresponding to the number of sealing lips could then be provided in the periphery of the bushing 49 into which the sealing lips could be inserted. These grooves would run parallel to the longitudinal axis of the bushing 49 and to the longitudinal axis or the axis of rotation 10.

The wedge-shaped sealing lips 75 extend in a star-like pattern from the bushing 49 and are conical or pointed in the direction leading away from the bushing. This is advantageous because the sealing lips have a sharp sealing edge 78, which ensures a good seal with surface 9. Naturally, the shell seal 64 can also be made without the raised sealing lips 75. In this case the sealing effect is achieved merely by the contact between the shell seal and the opposite surface 9 interacting with it.

The inside dimensions of the receptacle 21, i.e. the distance between the two cover parts inside the housing, is chosen with respect to the height of the oscillating piston wing 8 and/or the length of the bushing 49 in such a manner that the wing seal 51 and the bushing seal sections 68 make contact respectively with the inside walls of the cover parts 27 and the shell surface 11. At the same time, the shell seal 64 or at least one of the sealing lips 75 makes contact with the sealing surface 9 which, for the sake of simplicity, is flat, and is located on the inside 79 of the cover, which faces toward the working spaces 4,5. As the length of the first lever arm (distance meansured between the axis of rotation 10 and the outer surface of the shell seal 64 or a sealing lip 75) is very small, it is possible to make the opposite surface 9 relatively small. This reduces manufacturing costs.

The height of the housing 1, which essentially depends on the height of the oscillating piston 3, can be varied according to the desired piston area. In order to generate a high drive torque, a flat housing is preferred, in which the height of the housing 1 is smaller than the radial extension of the oscillating piston 3. The oscillating piston motor described above is very compact and a high driving torque is obtained. It is advantageous to manufacture the receptacle 21 and/or cover 22 in one piece and without using a cutting process, for example, out of plastic or as a zinc die casting. After they have been made, they can be taken from the mold at the dividing plane 20 which separates the receptacle 21 and the cover 22. This completely eliminates any burrs on the running surface of the oscillating piston 3 and no secondary operations are necessary.

FIG. 3 shows a cross section of the oscillating piston motor, along line III—III in FIG. 1. The free end 25 of the shaft 2 now extends downwardly and has a dog 30 extending along its axis and protruding along its radius. This dog might, for example, be a key which would enable a load to be easily connected with positive locking. The shaft 2 is supported by the bearings 24, for example ball bearings, in the receptacle 21. Bearing extensions 17 projecting from the cover parts 27 of the receptacle 21 are formed on the receptacle 21 in the longitudinal direction of the shaft 2 to receive the bearings 24. It is advantageous if the bearing extension 17 extends axially outwardly from the receptacle 21. It is not necessary to provide special seals for the shaft 2 where is passes through the receptacle 21. The sealing is provided by the bushing seal sections 68 on the packing surrounding the oscillating piston 3. Despite this, it is, of course, possible to provide a sealing ring; for example, a conventional sealing or wiper ring. The bearing system 24 can be simplified if the bearings are friction bearings similar to guide sleeves (not shown). The distance that the shaft 2 extends into the housing 1 is limited by a collar 32 extending radially from the shaft 2, the end of which is in contact with one of the bearings 24. On the opposite side of the housing, the shaft 2 is supported rigidly against the housing by means of the adjusting or limiting device 26.

On part of its length, the shank of the shaft 2 has peripheral toothing extending in the longitudinal direction of the shaft, for example a grooved toothing 34, a view of which is shown in FIG. 3. This embodiment uses a spline-type connection with straight sides, which has exceptionally low manufacturing costs. The toothing 34 ensures a rigid connection of the shaft 2 with the oscillating piston 3, as well as with an adjusting disk 35 of the adjusting device 26. In order to obtain a rigid connection, the hollow cylinder forming the bushing 49 of the oscillating piston 3 has on its inside surface toothing 31 which matches the peripheral toothing 34. The toothing 31 can be seen particularly clearly in FIG. 2. At the end 18 of the shaft 2, which is opposite to its free end 25, a toothed section 19 extends beyond the bearing 24. An adjusting disk 35 is placed on this section 19 in such a manner that the two parts cannot move with respect to each other. The disk 35 has a central hole 13 in which toothing corresponding to the toothing 31 of the bushing 49 has been machined. The longitudinal axis of the hole 13 is identical with the axis of the adjusting disk 35, which is therefore coaxially mounted on the shaft 2. In order to lock the disk 35 in position, it is secured to the shank of the shaft 2 by means of a lock ring 36. In the area of the hole 13, the disk 35 is in the shape of a sleeve 14, so that when the adjusting disk 35 has been put in place, one end of the sleeve 14 is in contact with the bearing 24 and the other end with the locking ring 36.

Figure 4:
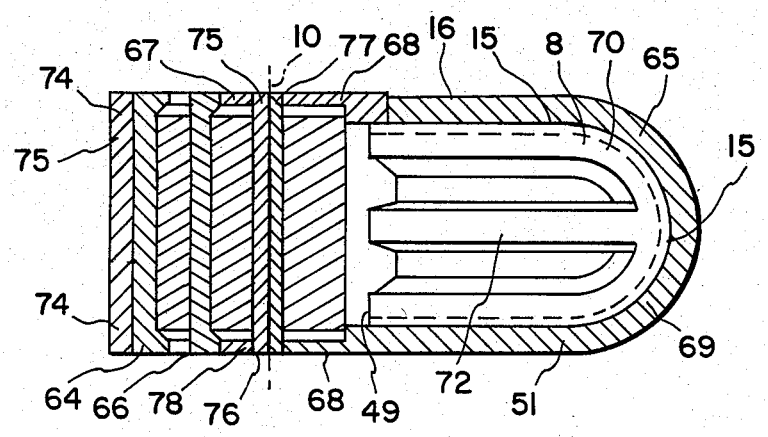
FIG. 4 is a side view of the oscillating piston shown in FIG. 2.

FIG. 3 shows, in addition, the two-piece structure of the housing 1 formed by a receptacle 21 and a cover 22 for the receptacle 21. It also presents a sectional view of the oscillating piston 3 already described in connection with FIGS. 2 and 4, again showing the bushing 49 and the wing 8 of the oscillating piston, both made in one piece. The oscillating piston 3 moves in the receptacle 21 and is sealed with respect to the receptacle 21 and the cover 22 by the packing 51. Once again, 64 designates the shell seal (in cross section) which interacts with the oppsosite surface 9 on the cover 22. In the area of the end surfces 66, 67 of the bushing 49, the sectional view clearly shows annular shoulders 80 formed on the oscillating piston, into which part of the packing 51 can be introduced to hold it in place. In particular, the packing 51 may be made of plastic sprayed onto the oscillating piston 3. The interior surface 79 of the cover 22 faces the receptacle 21. This surface is provided with a packing 52 which is inserted into a groove 81 in the interior surfaces 79 of the cover 22. Ideally, the groove will be in the shape of a closed surface channel. The annular groove 81 forms this channel. The contour of the sealing channel corresponds to the contour of the edge 54 of the open end of the receptacle 21, so that the edge 54 of the receptacle 21 can be inserted in the groove 81, with the packing 52 between. The depth to which the receptacle 21 can be inserted in the groove is limited by a step 55 on the outer edge of the receptacle's front surface. This makes the receptacle 21 flush with the cover 22. The groove 81 may have an oval shape that corresponds in particular to the shape of the edge 54.

FIG. 3 shows once again how the receptacle 21 is made up of a section 23 that consists essentially of a semicircular-cylinder and the sections 27 formed thereon. The receptacle 21 is made of a single piece throughout the sealing and working area of the oscillating piston 3. In particular, there are no sealing points in the housing in the entire sweep area of the wing 8 of the oscillating piston. The receptacle 21 can be made without joints or burrs from plastic or as a die casting, in which case it is removed from the mold starting with the opening which is closed by the cover 22. This method of production is particularly cost-efficient and has the advantage that the sealing area of the oscillating piston 3 does not require any secondary operations. The cover 22 is essentially flat and contains the connections for the pressure medium (not visible in FIG. 3) each of which opens into one of the working spaces 4,5 delimited by the oscillating piston 3.

Figure 5:
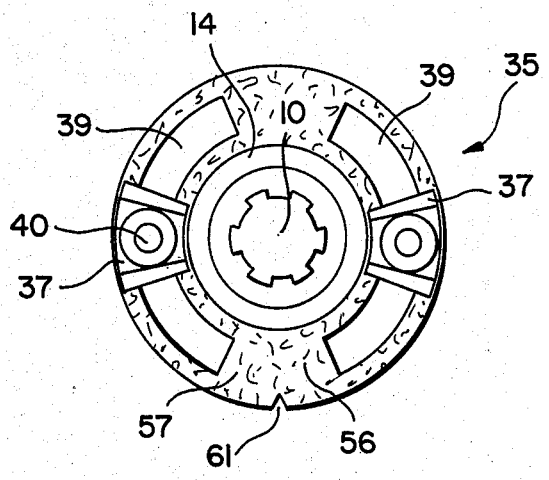
FIG. 5 is a bottom view of an embodiment of the adjusting disk.

As can be seen from FIG. 3 and 5, the adjusting device 26 is associated with the free end 18 of the shaft 2. It includes an adjusting disk 35 that is locked to the toothed section 19 of the shaft 2 by means of toothed components which have already been described. The adjusting disk 35 is approximately circular and bears at least one stop 37 whose angular position on the disk 35 can be adjusted. As can also be seen from FIG. 5, which shows the adjusting disk 35 separately and with two stops 37, the stop 37 can, in particular, be wedge-shaped, i.e. its sides facing toward or away from the shaft 2, are circular-cylindrical in shape and the lateral sides are radial planes. In order to limit the angle of rotation of the oscillating piston's movement, a counter-stop 38 which is firmly attached to the housing is provided for the stops(s) 37. According to FIG. 3, this counter-stop 38 is part of the cover 22 and has the same wedge-like shape slice as the stops 37. In principle, one stop 37 will suffice to adjust the angle of rotation of the oscillating piston motor that is the subject of the invention. It is preferable, however, to have two stops 37 limit the angle of rotation at both ends, in which case the stops can make contact with surfaces lying on opposite sides of the counter-stop 38. In particular, referring once again to FIG. 5, there is an elongated hole 39 in the shape of a circular arc in the adjusting disk 35, which is concentric with the axis of rotation 10 of the shaft 2. One elongated hole is provided for each stop. As can easily be seen from FIG. 3, the stops 37 consists of two jaws 40 which, when they are assembled on the adjusting disk 35 end up on opposite sides of the adjusting disk. The choice of a sufficiently great axial extensions of the sleeve 14 of the adjusting disk 35 and the interaction of this sleeve with the bearing 24 and/or the bearing extension 17 ensures that the clamping jaws 40 on the underside 41 of the adjusting disk 35 (the side which faces the oscillating piston), have enough space to rotate around the axis of rotation 10. The only restriction on the rotarty motion occurs in the area of the counter-step 38, which is in the path of motion of stop(s) 37, as a latter extends to a point close to the underside 41 of the adjusting disk 35. The jaws 40 of the stops 37 making contact with the undersides 41 each have a threaded hole which is aligned with the corresponding elongated hole 39 in the disk 35 and into which a screw 43 can be inserted from the upper side 42 (opposite to the underside 41) of the adjusting disk 35. The second jaw 40 of the stops 37 is then brought between the upper side 42 and the head of the screw 43 and thus forms something resembling an abutment, so that tightening the screw 43 causes the two clamping jaws 40 to hold fast to the adjusting disk 35. If the screw is slightly loosened, the stops 37 can be continuously shifted along the elongated hole 39, which makes it possible to continuously adjust the angle of rotation of the oscillating piston motor.

A friction lining 56 is applied to one of the surfaces of the adjusting disk 35, at least in the area where the corresponding stops are being moved. As shown in FIGS. 3 and 5, the disk surface 57 located on the underside 41 is completely covered with a friction lining 56. As a result, the clamping surface 58 of the corresponding clamping jaw 40, which faces the disk surface 57, is pressed firmly against the friction lining 56 when the stops are clamped firmly to the adjusting disk 35. The interaction of the friction lining and the clamping surface of the stops holds the stops even more securely in place when they make contact with the counter-stop 38. The friction lining prevents the stops from sliding into another position, so that the forces holding the stops in place are substantially increased. In order to further increase the clamping action, the friction lining according to the invention can also be applied to the disk surface 59 on the upper side 42 of the adjusting disk 35 as shown in FIG. 3. The use of the friction lining has the additional advantage that, for the stops 37 to be accidentally shifted, it is necessary to overcome not only the clamping force of the clamping screw 43, but also an additional force resulting from the coefficient of friction of the friction lining and clamping surfaces which are in contact with each other.

The friction lining can be produced as one piece with the adjusting disk or it can be produced separately and firmly applied to it. The friction lining may consist of granulated material, like that used for sandpaper or of material similar to a brake lining. Another possibility is to apply the friction lining to the adjusting disk by means of a cold forming process or by means of a spraying process, such as metal spraying.

In order to protect the adjusting device and to give the oscillating piston motor that is the subject of the invention an aesthetically pleasing outside appearance, the adjusting disk 35 with the stops 37 is covered by a cap or hood 44 which can be placed over the adjusting disk and rotates with it. This also prevents foreign material from penetrating into the adjusting device and blocking the path of the stops. When the cap 44 is placed on the adjusting disk 35, there is sufficient free space between the upper side 42 of the adjusting disk and the inner surface of the cap cover at 60 to receive the upper clamping jaws 40 of the stops. The inside 60 of the cap cover also has an axial annular extension 45 which limits the depths of insertion of the cap 44, because the free edge of the axial extension is in contact with the adjusting disk. The inside diameter of the cap 44 and the outside diameter of the disk 35 are coordinated in such a manner that, on the one hand, it is possible to place the cap on the adjusting disk 35 and, on the other, a clamped connection exists between the two parts. As a result, it is not necessary to provide a screw to hold the cap in place. It is, of course, also possible, however, to hold the cap in place by means of a screw, for example by inserting such a screw into a threaded blind hold provided in the front face of the free end 18 of the shaft 2. In order to fasten the cap so that it cannot rotate in relation to the adjusting disk 35, a tooth or the like (not shown in detail) is formed on the inside of the cap 44 which can be inserted in a matching notch 61 (FIG. 5) in the outer periphery of the disk 35. The top of the cap 44 also has openings 47 which permit the insertion of a tool for changing the positions of the stops 37. The openings 47 may, for example, follow the course of the elongated holes 39 in the adjusting disk 35, i.e. they can be arranged in circular arcs around the center of rotation of the cap 44. Any other shapes for the openings 47 can, of course, also be used. The openings 47 make it possible to apply a screw driver or socket wrench, depending on the type of adjusting screw 43 used, to the head of screws 43, to loosen them, to change the position of the stops 37 on the adjusting disk 35, and to retighten the screws.

Figure 6:
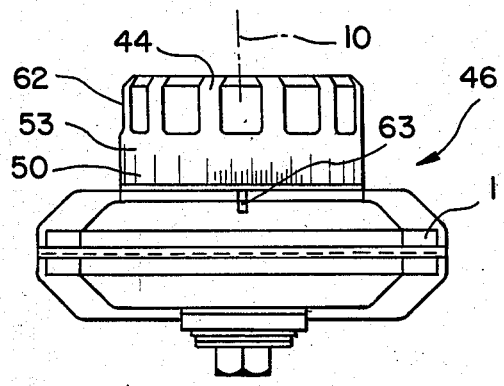
FIG. 6 is a front view of the oscillating piston motor according to the invention with the hood in place and at the top of the figure.

The invention also specifies that the adjusting device is provided with an indicator 46 which shows the instantaneous position of the oscillating piston. It is advantageous to connect this indicator with the adjusting disk in such a manner that they cannot rotate with respect to each other. I can, in particular, be mounted on the outside of the cap 44. FIG. 6 shows a side view of an oscillating piston motor to which a cap 44 with an indicator 46 has been attached. The indicator includes a scale 50 mounted on the exterior periphery 53 of the cap shell 62. It is advantageous to provide a large number of divisions on this scale, which is concentric with the axis of rotation. The indicator 46 also has an indicating element 63 in the form of a pointer which is firmly attached to the housing 1 and operates with the scale 50. This makes it easy to read the position of the oscillating piston at any time during operation and the adjustment of the maximum angle of rotation of the oscillating piston is made much easier, as the positions in questions can be easily read from the scale 50.

The oscillating piston motor according to the invention is of extremely compact design and is built from a very small number of parts. Its assembly is very simple. The best method is to insert the oscillating piston 3 into the receptacle 21. Then the shaft 2 is inserted through the toothed bushing 49, the adjusting device 26 is added and finally the receptacle 21 is closed with the cover 22.

A modification can easily be imagined in which there is no adjusting device 26, and it is also possible to equip the oscillating piston motor in a simple and advantageous manner with integrated signal transmitters for pneumatic or electric control. The continuous adjustability of the range of oscillation ensures universal applicability as a hydraulic or pneumatic rotating drive. An adjustable maximum angle of rotation of at least 180° or more is preferred. The oscillating piston motor in accordance with the invention can, for example, be used to operate doors, windows, dampers (for example dampers for silos) and fittings. In addition, the oscillating piston motor in accordance with the invention can perform many actuating motions, such as opening and closing valves or operating switches in transportation systems. Other possibilities for the use of oscillating piston motors include robot arms, manipulators, transfer and reversing stations, etc. Indexing tables with limited angles of rotation can be operated with a single oscillating piston motor in accordance with the invention, but it is also possible to build a slowly turning rotational drive by using, in a preferred application, intermittently operating oscillating piston motors which act on the same shaft through an overrunning clutch.

The oscillating piston motor can be produced at particularly low cost and with very effective sealing if the oscillating piston is sealed with respect to contact surfaces by a packing which completely envelops it. It is therefore advantageous if the oscillating piston is produced as a "rough part" and then sprayed with seaaling material. It is desirable to use as a sealing material an elastomer which coves all surfaces of the oscillating piston 3. This method of spraying the entire oscillating piston 3 or enveloping it completely in a one-piece prevents accidental separation of the packing from the oscillating piston. No seams or transition points exist where separation could begin.

It is advantageous to make the opposite surface 9 which interacts with the shell seal 64 of the oscillating piston 3 a plane surface, but it may also, particularly if the first lever arm (bushing) extends radially over a fairly large distance or is comparatively thick, be cambered or arc-shaped. It is also possible to form the opposite surface 9 directly on a part of the housing 1, for example on the cover 22 (i.e. using the material of cover 22 as the surface 9). But it is also possible to provide an additional seal on the housing surface 9 which then interacts with the shell seal 64.

The tracks or contact paths (shell surface 11 and opposite surface 9) in housing 1 on which the two lever arms (bushing 49, wing 8) of the oscillating piston 3 slide during the oscillation of the oscillating piston are placed in such a manner in relation to each other that one lever arm is permitted to leave its track only after the other lever arm has reached the point of its maximum excursion. Only by this method can oscillations of at least 180° be achieved. A reliable seal is ensured at all times between the oscillating piston 3 and the housing 1 that encloses it, so that the two working spaces 4,5 are sealed gas-tightly with respect to each other at all times.

While a specific embodiment of the invention has been shown and described in detail to illustrate the application of the principles of the invention, it will be understood that the invention may be embodied otherwise without departing from such principles.

What is claimed is:

1. Hydraulic or pneumatic oscillating piston motor with a housing (1), providing a shaft (2) mounted in the housing with freedom to rotate and providing an oscillating piston (3), manipulated with pressure, attached to the shaft so that it has torsional strength, shaped as a lever with two lever arms (49,8), having a different area of pressure, sealed against the inner shell surface of the housing (1) and separating two working spaces (4,5), which can be acted upon with pressure, the first of the two lever arms being designed as a hollow cylindrical bushing (49) disposed around the rotated shaft (2), the surface of a mantle portion of the bushing is covered at least over a part of its circumference by a shell seal surface (mantle sealing) (64) in the manner of a hollow cylinder, the seal surface providing tapered, rib - spaced sealing lips (75), formed to it in one piece, disposed along the circumference, uniformly distributed in the circumferential direction of the bushing (49), radially standing away and pointing away from the seal surface, the housing (1) being composed of a jointless receptacle (21) disposed around the shaft (2) in the direction of the circumference in the working area of the oscillating piston (3) and of a cap (22) covering the receptacle, and the seal surface (64) working together exclusively with a flat opposite-surface (9) disposed next to the cover (22) of the housing (1) without additional sealing, the second lever arm (8), possessing a larger radial reach and being sealed by a wing seal (65) about its periphery, which is connected in one piece with the seal surface (64) and a packing, which seals the axial surfaces of the bushing (49) against the housing, the path of the lever arms (49,8) in the housing (1) cooperate with one another in such a way, that one of the lever arms can leave its path only after the moment, in which the other lever has reached its largest deflection, the largest swing angle of the oscillating piston (3) being determinable by an adjusting device (26), comprising an adjusting disk (35) which is attached to the shaft, has torsional strength, and provides a friction lining (56) as well as comprising stops (37), chucked with a clamping surface (28) against the friction lining (56), and an indicating device (46) is correlated to the adjusting device (26), the indicating device showing the respective position of the oscillating piston (3) and comprising a scale (50) which surrounds the shaft (2) in a circular way, the scale being placed with torsional strength and resting on the cap (44), which can be stuck on the adjusting disk (35) and can cover it and the scale cooperating with an indicating organ (63) which is disposed firmly to the housing (1).

2. Oscillating piston motor pursuant to claim 1, characterized by the fact that the shell seal (64) embraces the bushing (49) over an angle of at least 180° or more.

3. Oscillating piston motor pursuant to claim 1, characterized by the fact that the distance between the outer circumference of the shaft to an opposite inner surface (9) of the housing is determined solely by the radial thickness of the bushing (49) and of the shell seal (64).

4. Oscillating piston motor pursuant to claim 1, characterized by the fact that the second lever arm (8) is disposed symmetrically to the shell seal (64) in two sealing parts having the same shape and extent.

5. Oscillating piston motor pursuant to claim 1, characterized by the fact that the sealing lips (75) have the form of a wedge, tapering to a point issuing from the shell seal (64), and their cross section diminishing more or less continuously.

6. Oscillating piston motor pursuant to claim 1, characterized by the fact that the sealing lips (75) stand away from the shell seal (64) in a star-shaped form.

7. Oscillating piston motor pursuant to claim 1, characterized by the fact that the sealing which surrounds and covers completely the oscillating piston (3) being sprayed around.

8. Oscillating piston motor pursuant to claim 1, characterized by the fact that the packing which seals the oscillating piston is composed of elastomer material.

9. Oscillating piston motor pursuant to claim 1, characterized by the fact that the friction lining (56) and the adjusting disk (#5) are formed in one piece.

10. Oscillating piston motor pursuant to claim 1, characterized by the fact that the friction lining (56) and the adjusting disk (35) are made separately from each other, but connected firmly to each other.

11. Oscillating piston motor pursuant to claim 1, characterized by the fact that the friction lining (56) shows a granulation like sandpaper, or is applied to the adjusting disk by a cold forming, i.e. like a cut of file.

12. Oscillating piston motor pursuant to claim 1, characterized by the fact that the friction lining (56) is applied to the adjusting disk (35) by coating, i.e. by metal spraying or a similar spraying procedure.

13. Oscillating piston motor pursuant to claim 1, characterized by the fact that the adjusting disk (35) is shaped like a key a comprises the friction lining (56).

14. Oscillating piston motor pursuant to claim 1, characterized by the fact that both disk surfaces (57,59) of the adjusting disk provide a friction lining (56).

* * * * *